US009723392B2

(12) United States Patent
Taylor

(10) Patent No.: US 9,723,392 B2
(45) **Date of Patent: *Aug. 1, 2017**

(54) HEADPHONES WITH CABLE MANAGEMENT

(71) Applicant: Bose Corporation, Framingham, MA (US)

(72) Inventor: Tristan Edward Taylor, Bolton, MA (US)

(73) Assignee: Bose Corporation, Framingham, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/433,203

(22) Filed: Feb. 15, 2017

(65) Prior Publication Data

US 2017/0164090 A1 Jun. 8, 2017

Related U.S. Application Data

(63) Continuation of application No. 14/226,074, filed on Mar. 26, 2014, now Pat. No. 9,609,415.

(51) Int. Cl.
*H04R 25/00* (2006.01)
*H04R 1/10* (2006.01)

(52) U.S. Cl.
CPC ..... *H04R 1/1033* (2013.01); *H04R 1/105* (2013.01); *H04R 1/1066* (2013.01)

(58) Field of Classification Search
CPC .... H04R 1/1008; H04R 5/033; H04R 1/1025; H04R 1/1066; H04R 1/1041; H04R 1/1083; H04R 5/0335; H04R 1/1033; H04R 2201/103; H04R 2420/07; H04B 1/088; H04B 1/16
USPC ..... 381/378, 379, 384; 379/430
See application file for complete search history.

(56) References Cited

U.S. PATENT DOCUMENTS 5,841,859 A * 11/1998 Chen ..... H04M 1/05 379/430
2013/0202126 A1* 8/2013 Chen ..... H04R 1/1041 381/74

* cited by examiner

*Primary Examiner* — Davetta W Goins
*Assistant Examiner* — Phylesha Dabney
(74) *Attorney, Agent, or Firm* — Brian M. Dingman; Dingman IP Law, PC

(57) ABSTRACT

Headphones that have one or two earphones. A headband carries the earphones such that they are held against the head of a wearer. A coupling member is located between the earphone and the headband, the coupling member pivotably mounted to the headband at a joint having a first axis around which the coupling member pivots, such that the earphone can be moved from a deployed position in which the earphone is positioned to be worn by the wearer to a stowed position in which the earphone is located closer to the headband than it is in the deployed position. A conductive cable runs from the earphone to the headband through the coupling member. The cable is held in place at a first anchor location in the headband, proximate the coupling member. There is slack in the cable between the first anchor location and the coupling member at least when the earphone is in the deployed position. The coupling member comprises a rigid loop overlying the cable and located adjacent to the slack in the cable, the loop extending away from the first axis. When the earphone is moved from the stowed position to the deployed position the rigid loop pushes the slack in the cable into the headband.

14 Claims, 9 Drawing Sheets

HEADPHONES WITH CABLE MANAGEMENT

CROSS-REFERENCE TO RELATED APPLICATION

This application is a continuation of and claims priority of application Ser. No. 14/226,074, filed on Mar. 26, 2014, the entire disclosure of which is incorporated herein by reference.

BACKGROUND

This disclosure relates to headphones.

Headphones carry earphones at the ends of a headband that fits over the head of the wearer. A microphone may or may not be included. The central portion that fits over the crest of the head is often a cushioned flat elongated tubular portion that is called a "cushion" or "cushion assembly." Elongated flat arms or "sliders" are slidingly engaged in each end of the cushion assembly and each carry an earphone at their distal end. This construction allows the length of the headband to be adjusted so as to fit comfortably over the head with the earphones proximate the ears. The earphones are typically rotatable or pivotable relative to the slider, often in at least two orthogonal dimensions. As one example, the earphones can be pivoted or folded inward toward the slider for storage.

A conductive cable runs through both sliders and the cushion assembly so as to electrically connect the earphones. In order to allow the slider to be pulled out of the cushion assembly and allow the earphones to rotate relative to the slider, the cable needs to have slack in it. The slack needs to be managed such that it runs smoothly in and out of the sliders and does not get pinched when the earphones are pivoted or folded.

SUMMARY

In headphones with pivoting stowable earphones and extendable and retractable sliders, cable management can be improved by retaining the cable near the earphone end of each slider, with slack on each side of the retention point. The slack between the slider and the earphone-carrying yoke can maintained in the slider with a rigid loop at the end of the yoke that overlies the cable so that the loop pushes the cable back into the slider when the earphones are moved from a stowed to a deployed position.

All examples and features mentioned below can be combined in any technically possible way.

In one aspect, the disclosure includes headphones that have one or two earphones. A headband carries the earphones such that they are held against the head of a wearer. A coupling member is located between the earphone and the headband, the coupling member pivotably mounted to the headband at a joint having a first axis around which the coupling member pivots, such that the earphone can be moved from a deployed position in which the earphone is positioned to be worn by the wearer to a stowed position in which the earphone is located closer to the headband than it is in the deployed position. A conductive cable runs from the earphone to the headband through the coupling member. The cable is held in place at a first anchor location in the headband, proximate the coupling member. There is slack in the cable between the first anchor location and the coupling member at least when the earphone is in the deployed position. The coupling member comprises a rigid loop overlying the cable and located adjacent to the slack in the cable, the loop extending away from the first axis. When the earphone is moved from the stowed position to the deployed position, the rigid loop pushes the slack in the cable into the headband.

Examples may include one of the following features, or any combination thereof. The headband may comprise a slider comprising a flat tube with a generally flat exterior surface that lies closest to the head, and the first axis may be below and generally parallel to the exterior surface of the slider. The slack in the cable may be located between the first anchor location and a first end of the slider when the earphone is in the deployed position. The headband may further comprise a generally tubular cushion assembly, and the slider may have a second end located in the cushion assembly, where the cable passes through the slider and the cushion assembly. The loop may be located in the slider when the earphone is in the deployed position.

Examples may include one of the above and/or below features, or any combination thereof. The coupling member may comprise a yoke extending from the joint with the headband, the yoke extending around a portion of the earphone and supporting the earphone at a position distant from the hinge. The coupling member may include a second, internal joint defining a second axis perpendicular to the first axis, around which the yoke pivots relative to the first joint to align the earphone to the user's ear when in the deployed position. The yoke may include a hollow channel through which the cable passes, such that the cable enters the earphone at the position where the yoke supports the earphone.

Examples may include one of the above and/or below features, or any combination thereof. The headband may comprise a generally tubular cushion assembly that has an inside and an outside and a slider that is located in part inside of the cushion assembly, and has a proximal end inside the cushion assembly and a distal end. The cushion assembly and the slider may be engaged so as to allow the slider to move in and out of the cushion assembly. The first location may be in the slider near its distal end. The cable may run through the length of the slider, and there may be additional slack in the cable between the first anchor location and the proximal end of the slider. The additional slack in the cable may be defined by a plurality of adjacent loops of the cable in the slider near the first anchor location.

Examples may include one of the above and/or below features, or any combination thereof. The headphones may further include a detent assembly at the joint between the headband and the coupling member. The detent assembly may comprise a catch member and a catch-receiving depression. The catch member may comprise a projecting portion of a spring member that is mounted to the headband so as to inhibit the pivoting of the coupling member, and the catch-receiving depression may be in the coupling member. The coupling member may have two, spaced, catch-receiving depressions that define the deployed and stowed positions. The coupling member may comprise a hub that rotates on an axle and is in contact with the spring member, and wherein the catch-receiving depressions are in the hub. The headband may comprise a tube made of two mated plastic parts that mate along longitudinal seams, and the spring member may be heat staked to one of the mated parts of the tube so that the spring member does not produce pressure on the seams. The two mated parts may comprise an upper part and a lower part, the spring member may be heat staked to the lower part, and the cable may be secured to the lower part at the first anchor location.

In another aspect, the disclosure includes headphones comprising a left earphone and a right earphone, a headband that carries the earphones such that they are held against the head of a wearer, two coupling members, one coupling member between each earphone and the headband, the coupling members each pivotably mounted to the headband at a joint having a first axis around which the coupling member pivots such that the earphone can be moved from a deployed position in which the earphone is positioned to be worn by the wearer to a stowed position in which the earphone is located closer to the headband than it is in the deployed position. A conductive cable runs from the earphones to the headband through the coupling members, wherein the cable is held in place at two anchor locations in the headband, each anchor location proximate a coupling member, and where there is slack in the cable between each anchor location and the respective proximate coupling member at least when the earphones are in the deployed position. The coupling members each comprise a rigid loop overlying the cable and located adjacent to the slack in the cable, such that when the earphone is moved from the stowed position to the deployed position the rigid loop pushes the slack in the cable into the headband. The headband may comprise a generally tubular cushion assembly that has an inside and an outside, and two sliders that are located in part inside of the cushion assembly, each slider having a proximal end inside the cushion assembly and a distal end. The cushion assembly and the sliders may be engaged so as to allow the sliders to move in and out of the cushion assembly. The anchor locations may be in the sliders near their distal ends. The slack in the cable and the loop may both be located in the sliders when the earphones are in the deployed position. The cable may run through the length of the slider, and there may be additional slack in the cable between the first anchor location and the proximal end of each slider, the additional slack defined by a plurality of adjacent loops of the cable in each slider near the anchor location.

In another aspect, the disclosure includes headphones comprising a left earphone and a right earphone, a headband that carries the earphones such that they are held against the head of a wearer, wherein the headband comprises a generally tubular cushion assembly that has an inside and an outside and two sliders, each comprising a flat tube with a generally flat exterior surface that lies closest to the head, the flat tube made of upper and lower mated plastic parts that mate along longitudinal seams, where each slider has a proximal end inside the cushion assembly and a distal end, wherein the cushion assembly and the sliders are engaged so as to allow the sliders to move in and out of the cushion assembly. There are two coupling members, one coupling member between each earphone and a slider, the coupling members each pivotably mounted to a slider at a joint having a first axis around which the coupling member pivots, wherein the first axis is below and generally parallel to the exterior surface of the slider, such that the earphone can be moved from a deployed position in which the earphone is positioned to be worn by the wearer to a stowed position in which the earphone is located closer to the headband than it is in the deployed position. A conductive cable runs from the earphones through the coupling members and through the sliders and the cushion assembly, wherein the cable is held in place at two anchor locations, one anchor location in each slider proximate a coupling member, and where there is slack in the cable located between each anchor location and the distal end of each slider when the earphones are in the deployed position, wherein there is additional slack in the cable between each anchor location and the proximal end of each slider, the additional slack defined by a plurality of adjacent loops of the cable in the slider near the first anchor location. Each coupling member comprises a yoke extending from the joint with the slider, the yoke extending around a portion of the earphone and supporting the earphone at a position distant from the hinge and a second, internal joint defining a second axis perpendicular to the first axis, around which the yoke pivots relative to the first joint to align the earphone to the user's ear when in the deployed position. The yoke includes a hollow channel through which the cable passes, such that the cable enters the earphone at the position where the yoke supports the earphone. The coupling members each comprise a rigid loop overlying the cable and located adjacent to the slack in the cable, each loop located in a slider when the earphone is in the deployed position, with the loop and extending away from the first axis. When the earphone is moved from the stowed position to the deployed position the loop pushes the slack in the cable into the slider. There are two detent assemblies, one at each joint between a slider and a coupling member. The detent assemblies each comprise a catch member and a catch-receiving depression. The catch member comprises a projecting portion of a spring member that is mounted to a slider so as to inhibit the pivoting of the coupling member, and the catch-receiving depression is in the coupling member. The coupling member has two, spaced, catch-receiving depressions that define the deployed and stowed positions. The coupling member comprises a hub that rotates on an axle and is in contact with the spring member, and the catch-receiving depressions are in the hub. The spring member is heat staked to the lower of the mated parts of the slider tube so that the spring member does not produce pressure on the seams of the slider tube, and the cable is also secured to the lower of the mated parts at the anchor location.

BRIEF DESCRIPTION OF THE DRAWINGS

FIG. 3A is a partial, exploded view of cable management for the headphones, while

DETAILED DESCRIPTION

The headphones herein have earphones that pivot between an extended use position and a retracted stowed position. The headphones also have sliders that engage a yoke that carries the earphones. The sliders extend and retract in and out of a cushion member that sits on the head. Cable management can be improved by retaining the cable near the earphone end of each slider, with slack on each side of this retention location. The slack between the slider and the earphone-carrying yoke can be maintained in the slider with a rigid loop at the end of the yoke that overlies the cable so that the loop pushes the cable back into the slider when the earphones are moved from the stowed to the deployed position.

Figure 1:
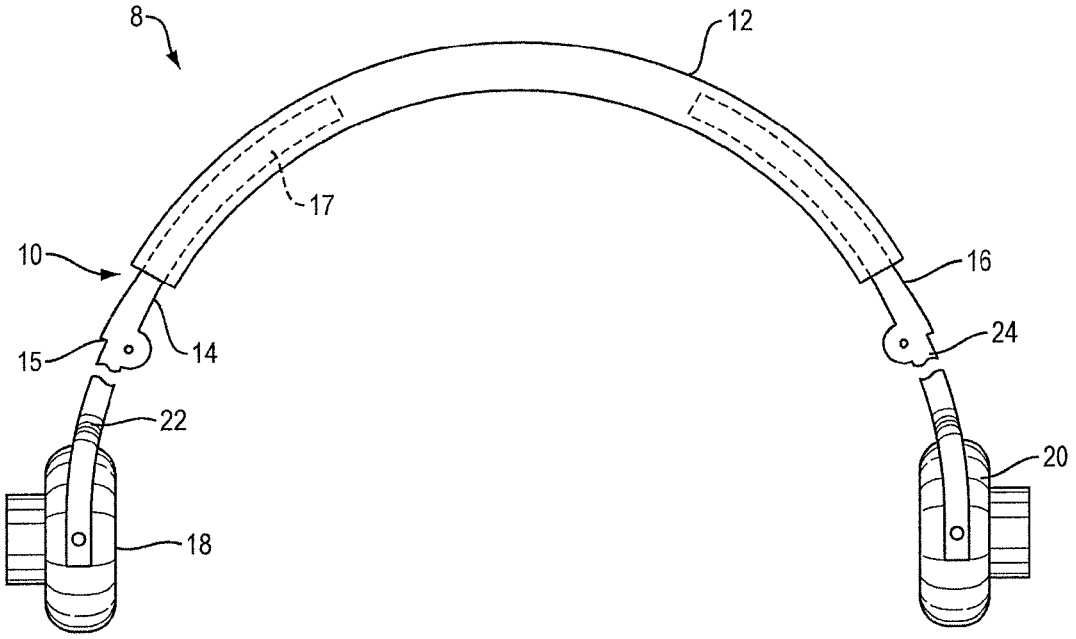
FIG. 1 is a front schematic view of headphones with cable management.

FIG. 1 shows headphones 8. Headphones 8 include headband 10 which includes flat tubular cushion assembly 12 that is constructed and arranged to be placed over the crown of the head of a person. Flat tubular sliders 14 and 16 support earphones 18 and 20. The sliders engage with cushion assembly 12 in a manner which allows the sliders to be moved in and out of the cushion assembly to adjust the overall length of the headband so that they headphones can sit comfortably on, in or over the ears of the wearer. This overall arrangement of headphones is known in the art. Also, in some cases a microphone (not shown) can be included so that the headphones can be used as a headset. Further, some headphones or headsets include only one earphone, in which case there may be only one slider.

Cushion assembly 12 is preferably generally tubular. This arrangement allows the sliders to be received within the volume on the inside of the tube and also allows wiring to pass along the length of the cushion assembly. Sliders 14 and 16 are located in part in this interior volume of the cushion assembly. Each slider has a proximal end located in the cushion assembly (e.g., end 17 of slider 14) and a distal end (e.g., end 15 of slider 14). Coupling members 22 and 24 (illustrated in FIG. 1 shortened from their actual length) are pivotably coupled to sliders 14 and 16. The coupling members each carry an earphone at their far ends. Earphones 18 and 20 are shown in FIG. 1.

The sliders are preferably but not necessarily each generally flat tubes with a generally flat exterior surface that lies closest to the head. In the example shown in the drawings, slider 14 has flat exterior surface 141 of lower half 140 of the slider tube. Pivot axis 50 that is defined by axle 130 lies below surface 141 and is generally parallel to surface 141.

Figure 2:
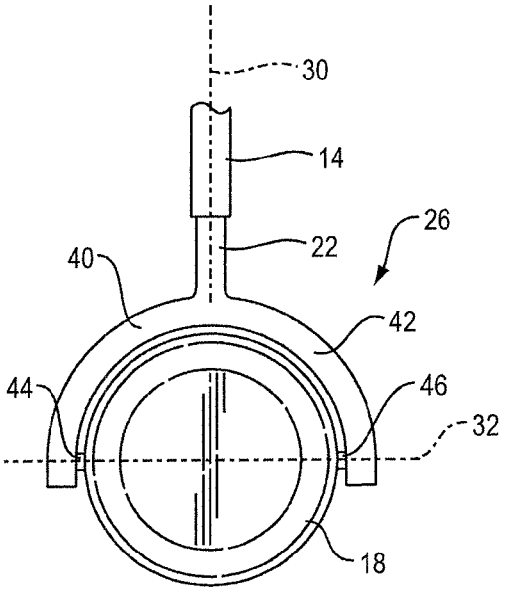
FIG. 2 is a partial side view of a yoke and earphone of the headphones.

An example of a coupling member 22 is shown in more detail in FIG. 2. Coupling member 22 comprises a yoke 26 with legs 40 and 42 that carry earphone 18. Earphone coupling members 44 and 46 are coupled to earphone 18 and allow it to rotate about axis 32. Also, coupling member 22 is engaged with slider 14 in a manner to allow the yoke to pivot about axis 30.

A conductive cable 60 which is shown in some of the drawings interconnects earphones 18 and 20 and carries the audio signals that are played by the earphones. Cable 60 is flexible, and runs through coupling members 22 and 24, sliders 14 and 16, and cushion assembly 12. Cable 60 needs to have sufficient length to accommodate both sliders being slid out of the cushion assembly to their endpoints, and also allow the earphones to be moved from the deployed position to the stowed position. At the same time, cable 60 needs to be managed so that it is unlikely to be bunched or pinched during use.

Figure 3A:
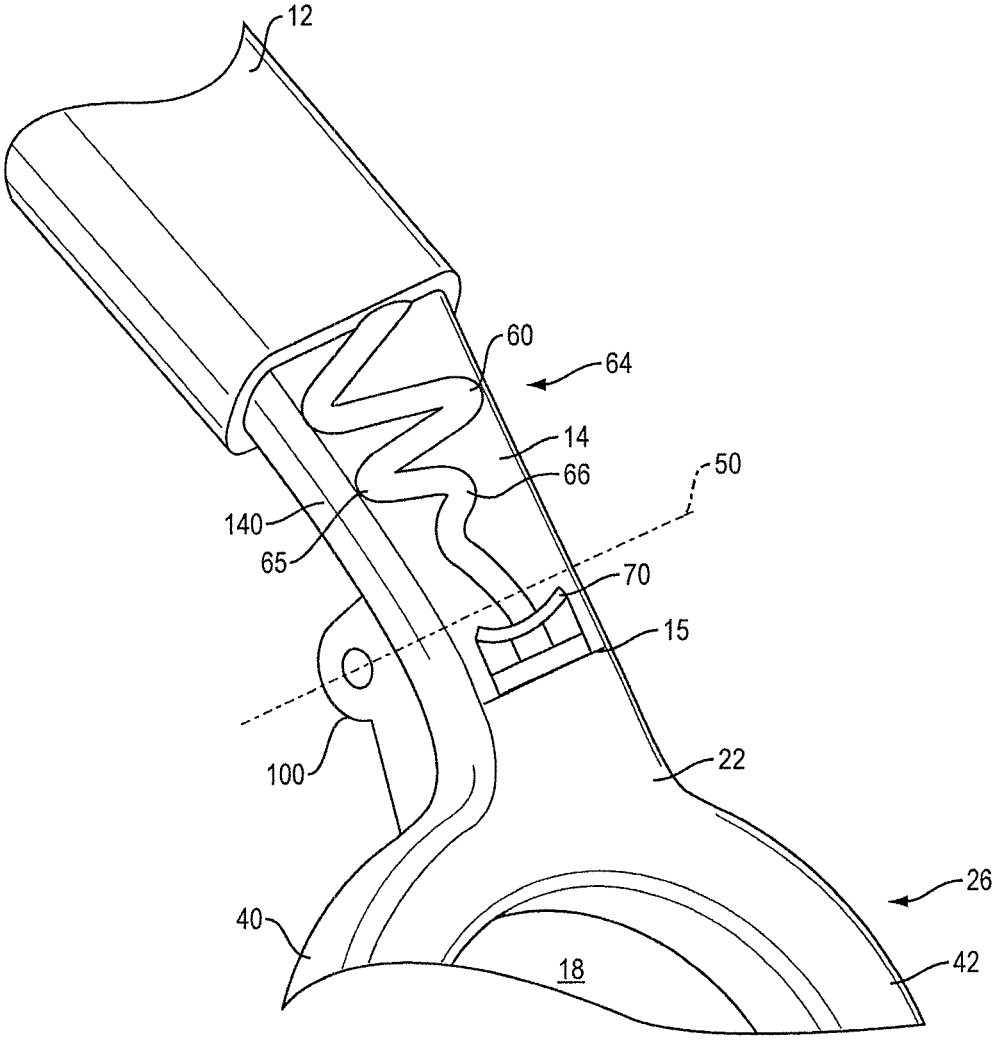
Figure 3B:
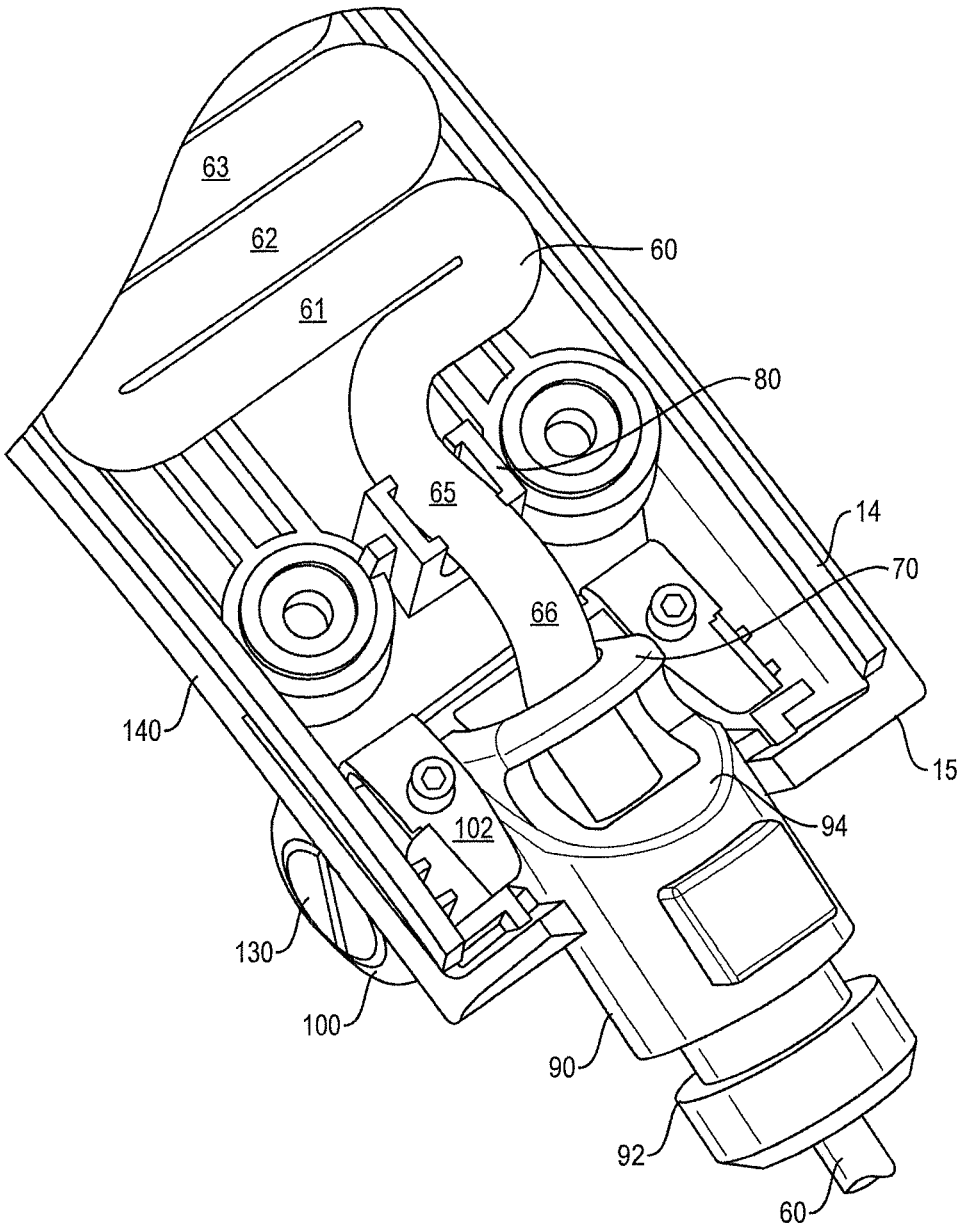
FIG. 3B is a more complete view.
Figure 4:
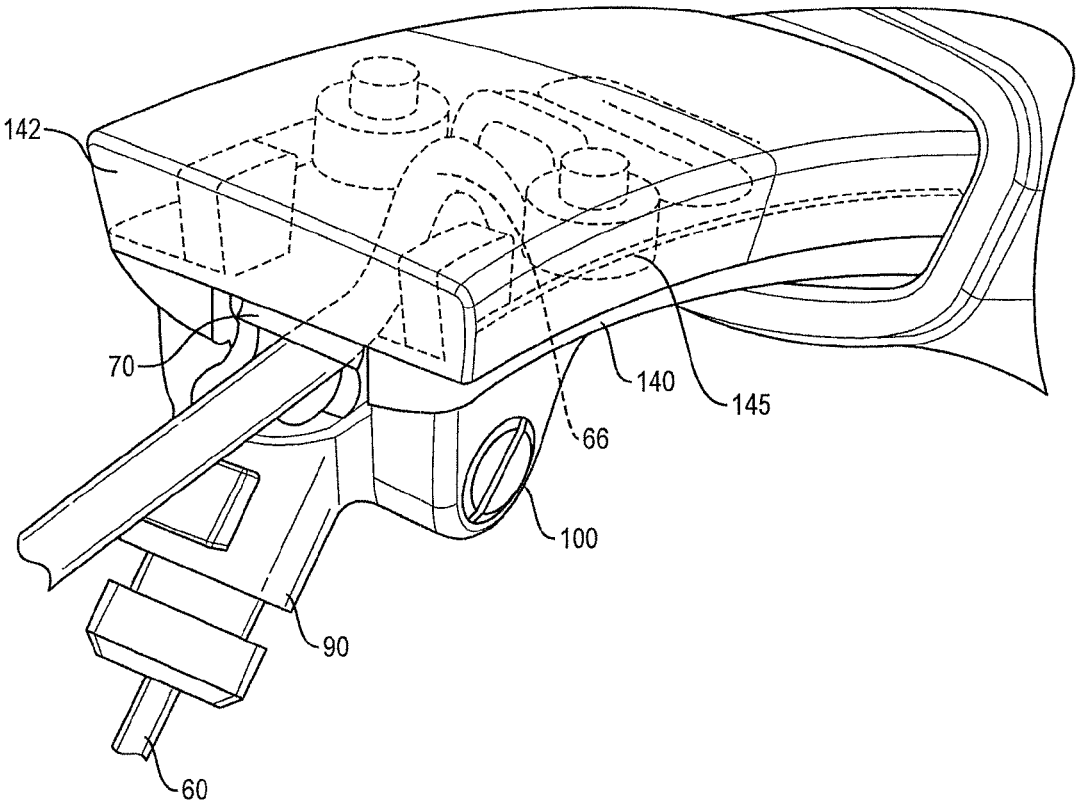
FIG. 4 shows an aspect of the cable management.
Figure 6A:
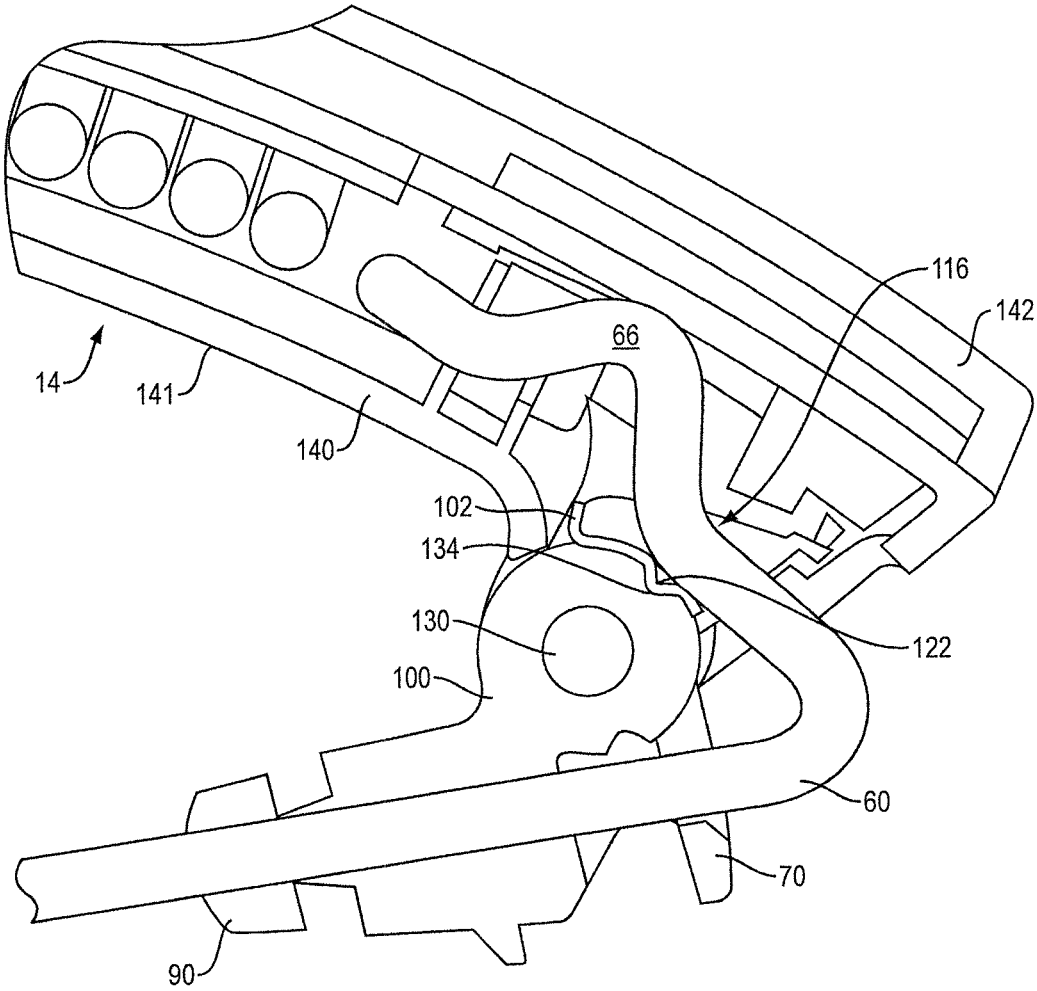
FIGS. 6A and 6B are cross-sectional views illustrating two positions of the detent assembly.

These twin objectives of cable slack and cable management can be at least partially accomplished as follows. FIG. 3A shows the bottom half 140 of slider 14 (the top half (or cover) 142 not shown for clarity purposes only but shown in FIG. 4). Cable 60 is held in place at anchor location 65 which is near the distal end 15 of slider 14. On each side of anchor location 65 there is slack in the cable. For example, on the side toward cushion assembly 12 cable slack 64 can be accomplished with a number of adjacent loops 61, 62, 63 and the like as shown in FIGS. 3A and 3B. On the distal side of anchor location 65, between location 65 and the distal slider end 15, there needs to be enough slack to accommodate the pivoting/folding of the yoke about axis 50 between the deployed position shown in FIGS. 3A and 6B, and the stowed position shown in FIG. 6A. The slack can be accomplished with an upstanding loop 66. The slack accomplished with loop 66 can be maintained in the slider as the yoke is pivoted between its deployed and stowed positions by including a rigid loop member 70 that is part of coupling member 22 and that overlies cable 60 adjacent to the slack in the cable. Rigid loop member 70 extends away from axis 50. When the earphone is moved from the stowed position in which it lies relatively close to the slider (e.g., as shown in FIG. 6A), to the deployed position in which it is more in line with the longitudinal axis of the slider (e.g., as shown in FIGS. 3A, 3B and 6B), rigid loop 70 pushes the cable slack into slider 14, where the slack forms loop 66.

Figure 6B:
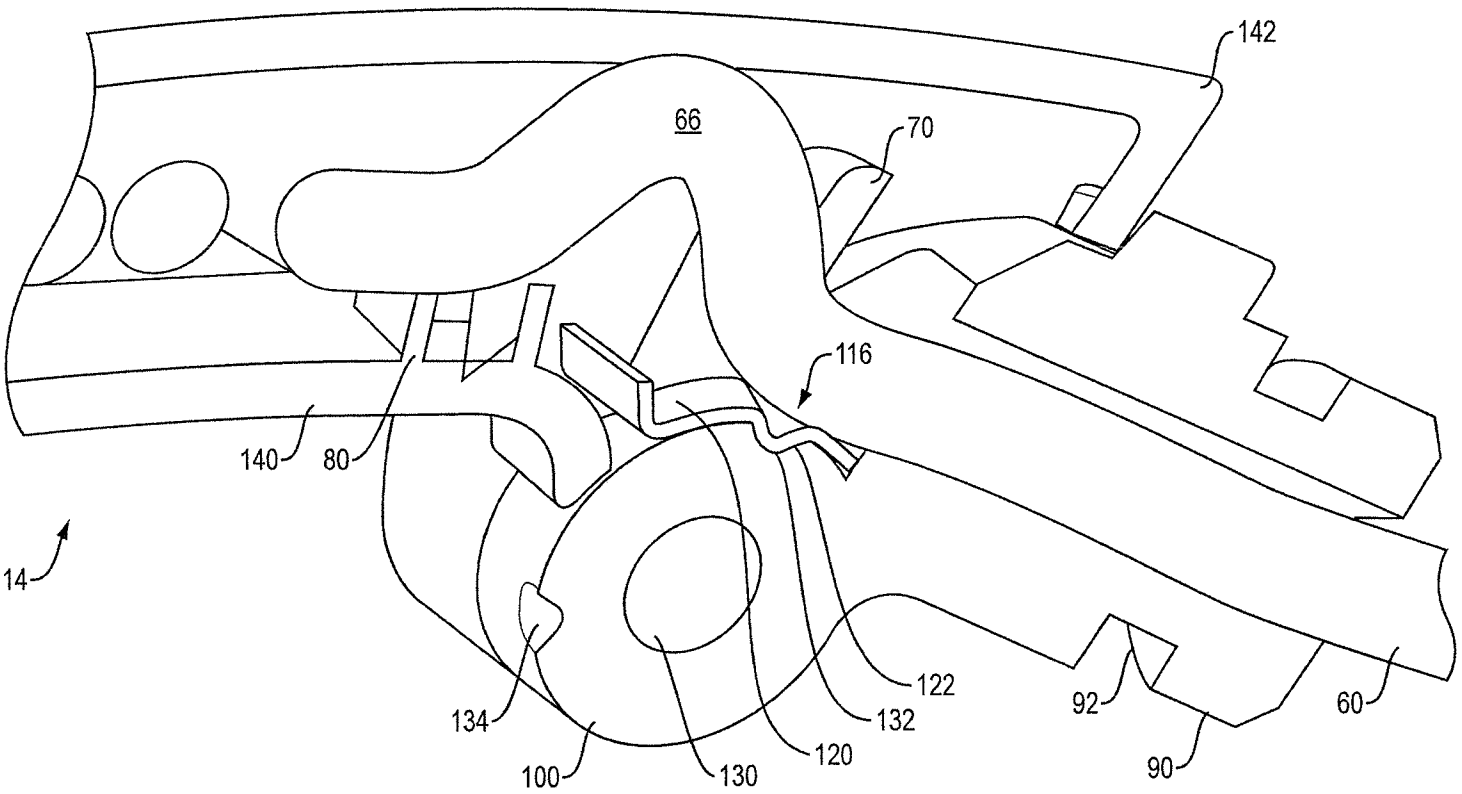

When the earphone is in the deployed position shown in FIG. 6B, cable loop 66 is pushed upward by rigid loop 70. When the earphone is moved to the stowed position shown in FIG. 6A, rigid loop 70 pulls some of the cable out of the slider, thus decreasing the size of cable loop 66. Then when the earphone is pivoted back to the deployed position, rigid loop 70 pushes this slack back into the slider. One result of this arrangement is that the slack that allows for the stowing of the earphones is less likely to be bunched or pinched in the joint between the coupling member and the slider.

One non-limiting construction that accomplishes this cable management scheme is shown in FIGS. 3-6. Cable 60 can be anchored at point 65 by molding into lower or bottom slider half 140 a saddle or other structure 80 into which the cable fits via an interference fit. Loops 61-63 are arranged adjacent to pinch point 65. Upstanding distal cable loop 66 is located between saddle 80 and rigid loop 70 that overlies the top of cable 60 at around the distal end of cable loop 66. Cable 60 then passes through generally tube-shaped channel member 90 into a channel (not shown) in yoke 26. Detent spring 102 and hub 100, FIG. 6B, are the main locating features for folding between the deployed and stowed positions. The yoke contacts or bottoms out against the slider when the yoke is in the deployed position.

Channel member 90 also includes shoulder 92 which rotatably supports the rest of yoke 26 in such a manner that it can rotate about the central longitudinal axis (i.e., axis 30) of channel member 90. One non-limiting manner in which this rotating support can be accomplished is described below.

Channel member 90 also includes hub 100 that is carried by and rotates about axle 130 that is part of slider 14. This arrangement allows the yoke to pivot about axis 50, FIG. 3A, which allows the earphones to be folded in against or close to the headband to present a smaller form factor in the stowed or storage position.

The headphones can also include a detent assembly at the joint between the headband and the coupling member. The detent assembly may comprise a catch member and one or more catch-receiving depressions. The catch member may comprise a projecting portion of a spring member. The spring member may be mounted to the headband in a manner such that it inhibits the pivoting of the coupling member. The catch-receiving depression(s) may be in the coupling member. The coupling member may have two spaced catch-receiving depressions that define or at least help to define the deployed and stowed positions. The catch-receiving depressions may be in the hub member.

Figure 5:
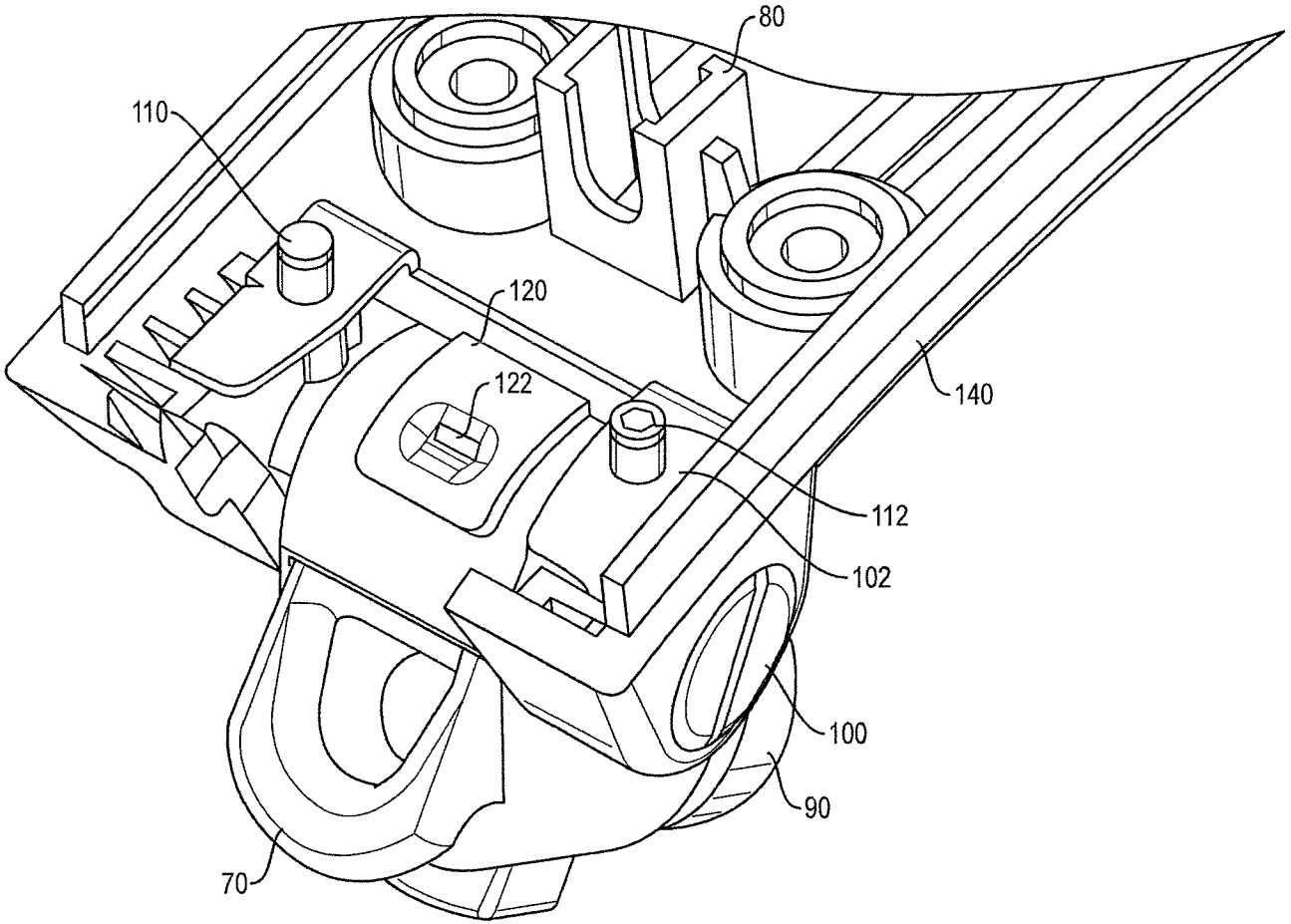
FIG. 5 shows part of the detent assembly.

As shown in FIGS. 5 and 6, spring member 102 may be carried by bottom half 140 of slider 14. Spring 102 may be heat staked to bottom half 140 using posts 110 and 112 that pass through openings in the spring and are heated and pressed down to flow into an enlarged mushroom shape that holds the spring down. One advantage of coupling spring 102 to only half of the slider is that the slider is made in a clamshell construction in which mating halves 140 and 142 meet at longitudinal seams such as seam 145, FIG. 4. Since the spring is entirely coupled to the lower half, the spring does not place any pressure on the seams, thus the flat tube created by the two halves does not tend to be pushed apart by the spring.

Spring 102 is located at the joint between channel member 90 and slider 14. As shown in FIGS. 6A and 6B, spring 102 in part has an arc shape such that it rides on the outside of hub 100. As a result, the spring provides some frictional force as the yoke is rotated between the deployed and stowed conditions, so that the folding is smooth and controlled. Also, the spring is part of the detent assembly that defines the stowed position shown in FIG. 6A and the deployed position shown in FIG. 6B. This is accomplished by including a projecting portion or catch member 122 of spring 102 that projects down into the arc-shaped periphery of hub 100. Hub 100 includes catch-receiving depressions 132 and 134 that are sized, shaped, located and arranged to interfit with projecting portion 122. When projecting portion 122 is not in one of these two depressions, it rides on the circular surface of hub 100. This causes upward pressure on the spring which causes it to flex and place more force on the hub as it is rotated. These actions together help to seat the hub in the catch member at the two defined positions.

Figure 7A:
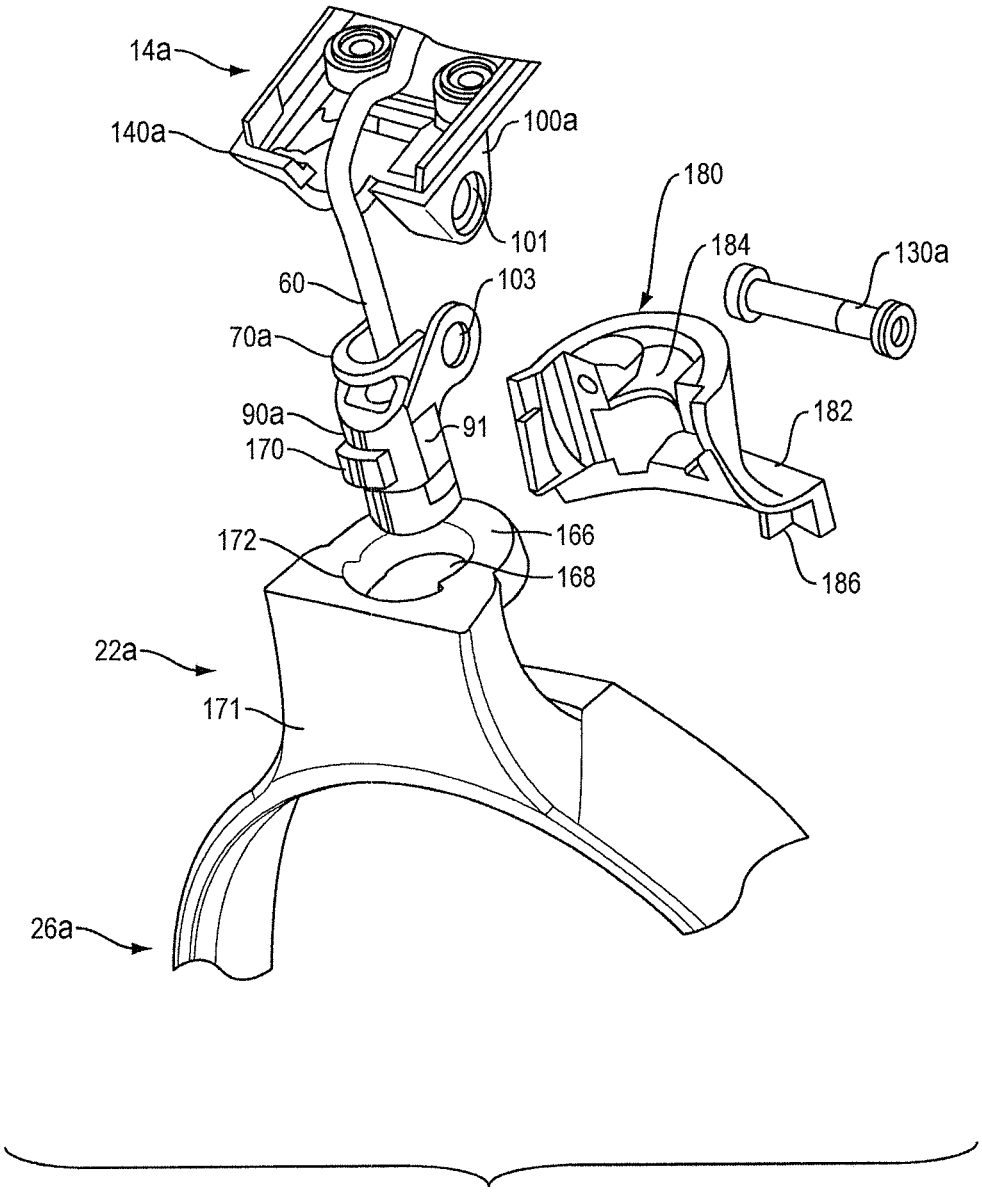
FIG. 7A is a partial, exploded view
Figure 7B:
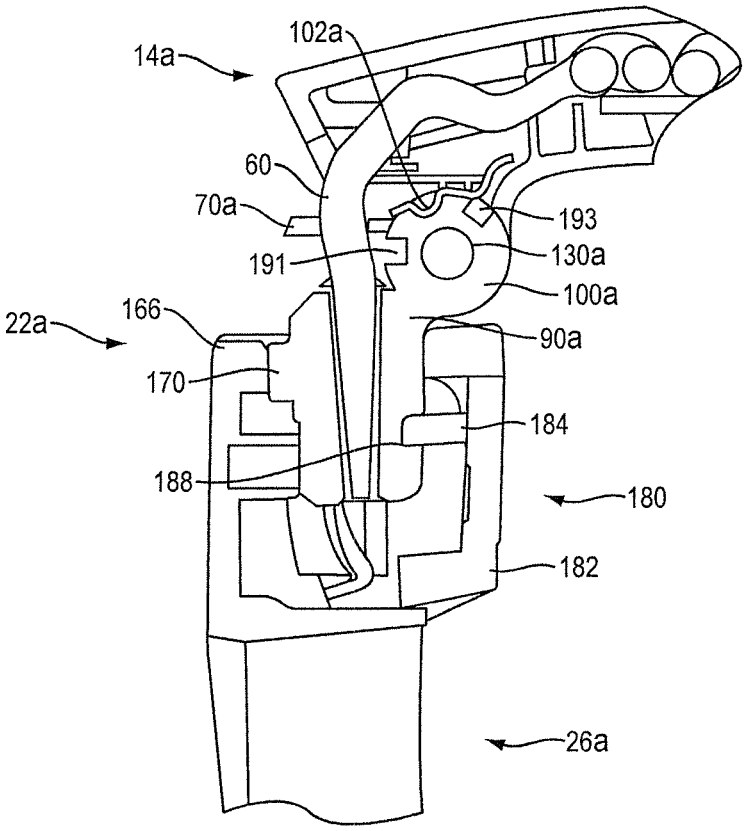
FIG. 7B is a partial cross-sectional view of aspects of an alternative example.

One of many possible alternative arrangements is shown in FIGS. 7A and 7B, which illustrates a different coupling member and channel member, among other aspects. The elements and element numbers used in FIGS. 7A and 7B correspond to those used in FIGS. 1-6, but with a small letter "a" used to denote an element which is similar to the correspondingly-numbered element in FIGS. 1-6. FIG. 7B illustrates a position between deployed and stowed so that the position detents are more visible.

In this non-limiting example, channel member 90*a* (which has rigid loop 70*a* which overlies cable 60 in the same manner as described above for rigid loop 70) engages with top 166 of top portion 171 of coupling member 22*a*. Member 90*a* is pivotable about bottom portion 140*a* of slider 14*a;* the pivoting is accomplished by aligning opening 103 of member 90*a* with opening 101 in hub 100*a,* and placing pivot pin or axle 130*a* through these aligned openings. Coupling member 22*a* has integral yoke 26*a,* which itself carries the earphones (not shown).

Body 91 of channel member 90*a* fits into opening 168 in top 166 of first portion 171 of coupling member 22*a*. Protrusion 170 is seated in recess 172 of opening 168; this fixes the rotational position of body 91 and portion 171. Second or cover portion 180 of coupling member 22*a* comprises a generally half-annular shell 182 with engagement features described below. Cover 180 is screwed into place onto first portion 171 of coupling member 22*a* and secures member 90*a* to member 22*a*. Semi-circular surface 184 fits into slot 188 in channel member 90*a;* this maintains member 90*a* in engagement with member 22*a*.

This example establishes two rotational detent positions of the yoke, coupling member and earphones relative to slider 14*a*. The catch of spring member 102*a* can fit into either of catch-receiving depressions 191 and 193 that are spaced about hub 100*a* so as to define a use or deployed position (depression 191) and a folded, stowed position (depression 193).

A number of implementations have been described. Nevertheless, it will be understood that additional modifications may be made without departing from the scope of the inventive concepts described herein, and, accordingly, other embodiments are within the scope of the following claims.

What is claimed is:

1. Headphones, comprising:

an earphone;

a headband that carries the earphone, wherein the headband comprises a generally tubular cushion assembly that has an inside and an outside, and a slider that is located in part inside of the cushion assembly, the slider having a proximal end inside the cushion assembly, and a distal end, wherein the cushion assembly and the slider are engaged so as to allow the slider to move in and out of the cushion assembly;

a coupling member pivotably mounted proximate the distal end of the slider at a joint having a first axis around which the coupling member pivots, such that the earphone can be moved from a deployed position in which the earphone is held proximate an ear of the wearer, to a stowed position in which the earphone is located closer to the headband than it is in a deployed position; and a conductive cable that runs from the earphone through the coupling member and into the slider, wherein there are a plurality of generally co-planar adjacent loops of the cable in the slider.

2. The headphones of claim 1, wherein the cable is held in place at a first anchor location in the slider proximate the coupling member, and there is slack in the cable between the first anchor location and the coupling member, at least when the earphone is in the deployed position.

3. The headphones of claim 2, wherein the slack in the cable is located between the first anchor location and the distal end of the slider when the earphone is in the deployed position.

4. The headphones of claim 2, wherein the generally co-planar adjacent loops of the cable are located between the first anchor location and the proximal end of the slider.

5. The headphones of claim 1, wherein the generally co-planar adjacent loops of the cable each comprise a relatively straight portion and a bend, wherein the relatively straight portions lay side-by-side.

6. The headphones of claim 1, wherein the coupling member comprises a rigid loop member overlying the cable and located adjacent to the slack in the cable, the rigid loop member extending away from the first axis, such that when the earphone is moved from the stowed position to the deployed position, the rigid loop member pushes the slack in the cable into the slider.

7. The headphones of claim 6, wherein the slack in the cable and the rigid loop member are both located in the slider when the earphone is in the deployed position.

8. The headphones of claim 1, wherein the cable runs through the length of the slider.

9. The headphones of claim 1, wherein the cable passes through the slider and the cushion assembly.

10. The headphones of claim 1, wherein the slider comprises a flat tube with a generally flat exterior surface that lies closest to the head, and the first axis is below and generally parallel to the exterior surface of the slider.

11. Headphones, comprising:

a left earphone and a right earphone;

a headband that carries the earphones, wherein the headband comprises a generally tubular cushion assembly that has an inside and an outside, and two sliders that are located in part inside of the cushion assembly, each slider having a proximal end inside the cushion assembly, and a distal end, wherein the cushion assembly and the sliders are engaged so as to allow the sliders to move in and out of the cushion assembly;

two coupling members, one coupling member between each earphone and the headband, the coupling members each pivotably mounted proximate the distal end of a slider at a joint having a first axis around which the coupling member pivots, such that the earphone can be moved from a deployed position in which the earphone is held proximate and ear of the wearer, to a stowed position in which the earphone is located closer to the headband than it is in the deployed position; and a conductive cable that runs from the earphones to the headband through the coupling members, wherein the cable is held in place at two anchor locations in the headband, each anchor location proximate a coupling member, and where there is slack in the cable between each anchor location and the respective proximate coupling member at least when the earphones are in the deployed position;

wherein the coupling members each comprise a rigid loop member overlying the cable and located adjacent to the slack in the cable, such that when the earphone is moved from the stowed position to the deployed position, the rigid loop pushes the slack in the cable into the headband;

wherein the anchor locations are in the sliders near their distal ends, and the slack in the cable and the rigid loop members are both located in the sliders when the earphones are in the deployed position; and wherein there are a plurality of generally co-planar adjacent loops of the cable in the slider, between each anchor location and the proximal end of each slider.

12. The headphones of claim 11, wherein the generally co-planar adjacent loops of the cable each comprise a relatively straight portion and a bend, wherein the relatively straight portions lay side-by-side.

13. The headphones of claim 12, wherein the generally co-planar adjacent loops of the cable are located between each first anchor location and the proximal end of each slider.

14. The headphones of claim 13, wherein each slider comprises a flat tube with a generally flat exterior surface that lies closest to the head, and each of the first axes are below and generally parallel to the exterior surface of the respective slider.

* * * * *